United States Patent [19]

Stevens

[11] Patent Number: 4,607,758

[45] Date of Patent: Aug. 26, 1986

[54] SERVING TRAY

[75] Inventor: Kenneth V. Stevens, Brooklyn, N.Y.

[73] Assignee: Grainware Company, Chicago, Ill.

[21] Appl. No.: 699,081

[22] Filed: Feb. 7, 1985

[51] Int. Cl.[4] ..... A47G 19/03; A47G 19/06

[52] U.S. Cl. ..... 220/23.83; D7/27; D7/38; 206/509; 206/563; 206/565

[58] Field of Search ..... 220/23.83, 23.86; D7/19, 27, 38; 206/562, 563, 565, 509

[56] References Cited

U.S. PATENT DOCUMENTS

| | | | |
|---|---|---|---|
| D. 197,618 | 3/1964 | Milbourne . | |
| D. 227,851 | 7/1973 | Nowland | D7/38 |
| D. 251,102 | 2/1979 | Box | D7/38 |
| D. 257,310 | 10/1980 | Cosmopulos . | |
| D. 261,588 | 11/1981 | Fichte . | |
| D. 270,324 | 8/1983 | French . | |
| 4,516,685 | 5/1985 | French | 220/23.83 |

FOREIGN PATENT DOCUMENTS

| | | | |
|---|---|---|---|
| 2078493 | 1/1982 | United Kingdom | 220/23.83 |

*Primary Examiner*—George E. Lowrance
*Attorney, Agent, or Firm*—James N. Videbeck

[57] ABSTRACT

An improved food serving, canape or hors d'oeuvre tray includes a portion which is adapted for retaining differing types of glassware thereon. The portion of the tray on which glassware is retained includes a flat base having a retaining wall around the periphery of the portion which retains a flat bottom glass or cup thereon. The glassware retaining portion also includes a slot or channel extending inwardly from its periphery to its center and has an enlarged generally circular distal end which is generally centrally positioned in the glassware retaining portion for retaining a stemware glass when positioned thereon.

4 Claims, 7 Drawing Figures

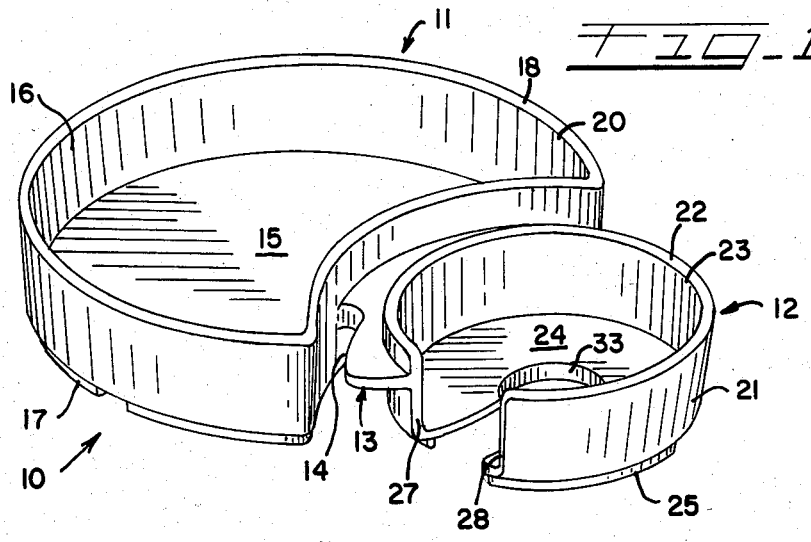
FIG. 1
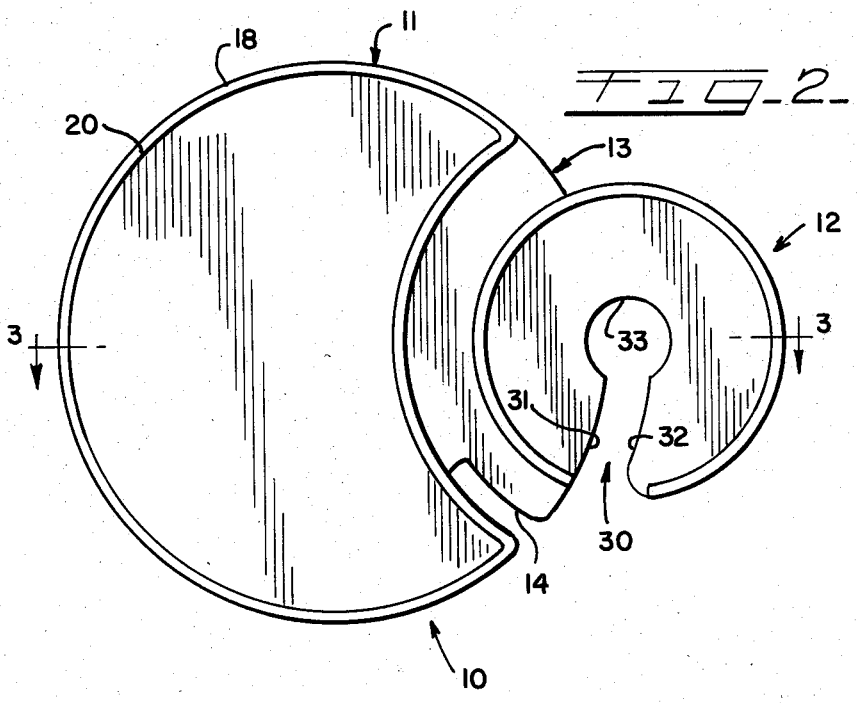
FIG. 2
FIG. 3
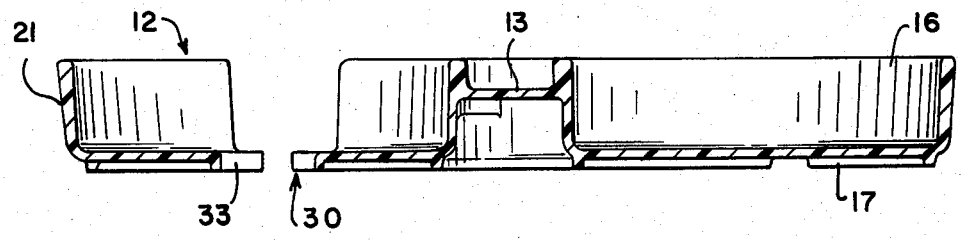

SERVING TRAY

BACKGROUND OF THE INVENTION

This invention relates to food serving, canape, hors d'oeuvre trays or the like, and more particularly, to improvements in a portion of the tray which is adapted to retain glassware when same is positioned thereon.

The problem of serving both solid foods on a tray and liquid foods in a glass contemporaneously without tipping the glass has long existed in connection with the use of food service trays. Additionally, when the tray is a smaller tray, such as a canape or hors d'oeuvre tray for use at cocktail parties and the like, the user should preferably be able to keep the tray in one of his or her hands during its use. Heretofore, known trays adapted to retain glassware thereon have either included substantial cup retaining walls which prevented stacking of the trays, or they have included cut outs for retaining stemware, but without the ability to retain a cup or flat bottom glass. Such trays are disclosed in patents DES No. 197, 618; DES No. 257,310; DES No. 261,588; and DES No. 270,324.

A need has developed for an improved food serving, canape or hors d'oeuvre tray which is adapted for being easily held by a user in one hand while having the capability of retaining both stemware and cups or flat bottom glasses thereon.

SUMMARY OF THE INVENTION

The invention is directed in a serving tray of the type having a base surface adapted for placement of food thereon and an improvement comprising retention means on the base adapted for maintaining any standard cup or flat bottom glass positioned on the retention means, and slot means on the base adapted for retaining a stemware glass when same is positioned thereon.

BRIEF DESCRIPTION OF THE DRAWINGS

The features of the present invention, which are believed to be novel, are set forth with particularity in the appended claims. The invention may be best understood from the following detailed description of a currently preferred embodiment thereof, taken in conjunction with the accompanying drawings, wherein:

FIG. 1 is a perspective view of the food serving or canape tray incorporating thereon the combined cup-stemware retaining portion of the present invention.

FIG. 2 is a top plan view of the food serving or canape tray shown in FIG. 1.

FIG. 3 is a cross section view taken substantially along line 3—3 of FIG. 2.

DETAILED DESCRIPTION OF THE PREFERRED EMBODIMENT

Figure 4:
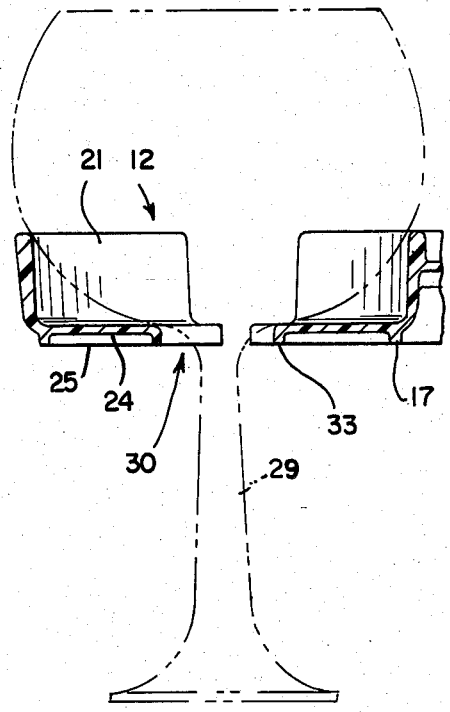
FIG. 4 is a fragmentary cross section view similar to a portion of FIG. 3 showing a stemware glass in phantom as same would appear retained thereon.

Referring to FIG. 1, a food service or canape tray 10, constructed in accordance with the present invention, includes a solid food retaining portion 11 and a liquid container retaining portion 12 thereon. In the preferred embodiment of the present invention, the solid food retaining portion and liquid container retaining portion are joined by a bridging or hand grasping portion 13 which, in this embodiment, includes a napkin or utensil retaining slot 14 thereon.

Figure 7:
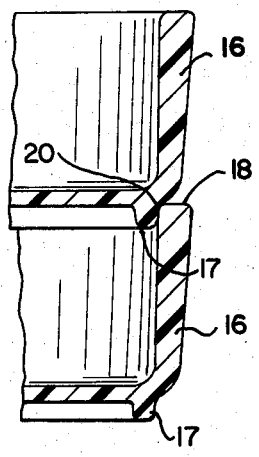
FIG. 7 is a fragmentary section view showing the stackability of the trays of the invention.

Solid food retaining portion 11 includes a generally flat base 15, a substantially vertical retaining wall 16 surrounding the periphery of base 15 and adapted for retaining canapes, hors d'oeuvre, or other food positioned on base 15, and bottom ridge or foot portions 17—17 below base 15, also shown in FIGS. 3, 6 and 7, having the same general configuration as wall 16 but positioned inwardly thereof with respect to base 15 so as to be retained within the upper confines of wall 16 when stacked thereon as shown most clearly in FIG. 7. In the present invention, the outline of solid food retaining portion 11 and liquid container retaining portion 12 are both circular in shape with container retaining portion 12 being positioned partly inside the circular outline of solid food retaining portion 11 to define a somewhat crescent shaped sidewall 16 having a thin substantially flat top surface 18, the interior edge 20 of which is adapted for receivingly retaining bottom ridges 17—17 on an adjacent stacked tray.

Between the solid food retaining portion 11 and the liquid container retaining portion 12, the bridging portion 13 is a substantially flat generally C shape horizontal wall which, in this embodiment, is positioned about midway up the retaining wall 16. Bridging portion 13 is substantially continuous in shape with exception of a cut out notch or slot 14 extending inwardly adjacent the front thereof which is adapted for retaining a folded napkin or eating utensil therein. In a user's preferred grasping position, the tray is shaped to be held in the left hand with the thumb on top of bridging portion 13 and most or all the remaining fingers under portion 14. The grasping position described allows the user's right hand to be free to move a cup or stemware in and out of container retaining portion 12 in a natural arcuate movement. The shape of the tray of the invention has been conceived to ease user social interaction, for example, to free a user's right hand for greeting purposes, Other convenient grasping orientations may also be utilized.

Referring to FIGS. 1-6, the liquid container retaining portion 12 is generally cylindrical in configuration and defined by a vertical upstanding sidewall 21 having a height and thickness similar to that of sidewall 16 and includes an upper generally flat surface 22 having an interior edge 23 thereof similar to surface 18 and 20 of the solid food retaining sidewall 16. Retaining portion 12 further includes a substantially flat base 24, which is preferably positioned in the plane of complementary base 15, and also includes a foot portion or stacking bottom ridges 25—25, shaped so as to nest inwardly of the inner edge 23 and top surface 22 of an identical canape tray when stacked thereunder. The bottom ridges or foot portions 17, 25, respectively may be of continuous ring or discontinuous foot configuration, as desired.

Figure 5:
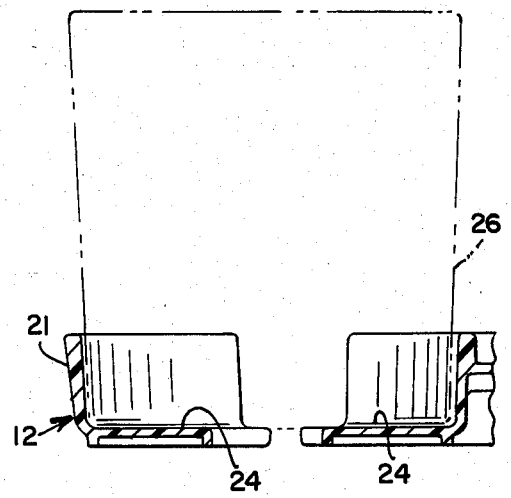
FIG. 5 is a fragmentary cross section view similar to FIG. 4 showing a flat bottom glass or cup in phantom as same would appear retained thereon.

As shown most clearly in FIG. 5, the dimensions of liquid container retaining sidewall 21 and base 24 provide a slightly greater diameter in the interior thereof than that if a standard coffee cup or flat bottom glass, i.e., greater than approximately three inches in diameter. A coffee cup or mug outline is shown in phantom at 26 as it would appear nested in liquid container retaining portion 12 with the bottom of the cup resting on flat base 24. In order to retain a coffee cup or mug having an external handle thereon, liquid container retaining portion sidewall 21 is made discontinuous adjacent the front thereof, as shown most clearly in FIG. 1, by including a cut out portion defined by a vertical end walls 27, 28, respectively, which are spaced sufficiently to allow any conventional cup or mug handle to extend forwardly therethrough.

Vertical end walls 27, 28 not only define an opening in the generally cylindrical sidewall 21 for positioning a cup handle therethrough, but also define an entryway for a slot 30 in base 24 which is adapted to retain a piece of stemware therein such as a wine glass as shown in phantom at 29 in FIG. 4

Figure 6:
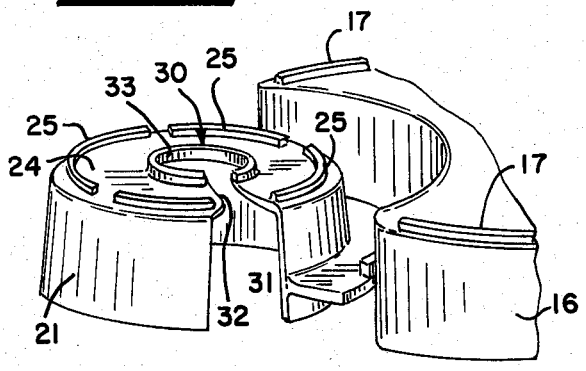
FIG. 6 is a fragmentary perspective view of the tray bottom showing the glass retaining portion of the invention.

As shown most clearly in FIGS. 2 and 6, slot 30 is preferably of a key-hole shape, although other slot configurations may be utilized to perform the same function. Slot 30 includes an elongate internally extending access portion defined by slot sidewalls 31, 32 which extend inwardly of portion 12 from vertical end walls 27, 28, respectively, and a generally circular enlarged central portion 33 which is adapted to receive and retain a stemware glass therein, as shown in FIG. 4.

As shown most clearly in FIG. 6, stacking ridges or foot portions 17—17 and 25—25 are positioned inwardly adjacent the outer vertical walls 21 and 16, respectively, a sufficient distance to allow the ridges to nest inside of those respective sidewalls in an identical canape tray when positioned in stacked relation thereover. Vertical walls 31, 32 and 33, respectively, which define the stemware retaining slot 30 may also extend downwardly from the bottom of the floor 24 in the liquid containing portion, as desired, to provide added strength and rigidity to the floor of the liquid container portion.

Thus, a food serving tray of the type utilized as a canape or hors d'oeurve tray has been shown and described which provides for ease of use by providing the ability to mount and retain either a cup or stemware glass thereon in a stable retained position, and also allowing the placement of hors d'oeuvres or other food on the tray while adapted for being held by one hand of a user. While a canape tray has been shown and described, it will be understood that other tray configurations may be utilized within the scope of the invention, such as cafeteria trays, or the like, as long as they have the capability of retaining either a flat bottom glass, coffee mug, or the like, and a stemware glass thereon.

While one embodiment of the present invention has been shown and described, it will be obvious to those skilled in the art that changes and modifications may be made without departing from the invention in its broader aspects. Therefore, the aim in the appended claims is to cover all such changes and modifications as may fall within the true spirit and scope of the present invention.

The invention is claimed as follows:

1. In a stackable serving tray having a food retaining portion, a liquid container retaining portion, and being adapted for stable positioning on a flat surface of in a user's grasp when both food and a liquid container are positioned thereon, said food retaining portion and said liquid container retaining portion both including substantially horizontal bottom walls and foot means on said bottom walls for providing both a planer bottom mounting surface for said tray and a nesting surface for retaining said tray in stackable relation above any like tray aligned subjacently thereto, said horizontal bottom wall of said liquid container portion including a first sidewall extending generally upwardly from a substantial portion of the periphery thereof for retaining a standard cup or flat bottom glass thereon, and slot means on said horizontal bottom wall of said liquid container retaining portion extending from the center thereof outwardly to define an opening in said sidewall for receiving and retaining a stemware glass when same is positioned thereon.

2. The stackable serving tray as defined in claim 1 wherein said food retaining portion and said liquid container retaining portion are positioned on opposing sides of a bridging portion therebetween which is adapted for user grasping, and wherein said opening in said sidewall is positioned substantially immediately adjacent one end of said bridging portion.

3. The stackable serving tray as defined in claim 1 wherein said bottom wall of said food retaining portion includes a second sidewall extending generally upwardly from the periphery thereof, said first sidewall on said liquid container retaining portion being joined in fixed spatial relation by a substantially horizontal bridging wall positioned therebetween, and said bridging wall including an elongate slot extending inwardly from an outer edge of said bridging wall for retaining a napkin or eating utensil therein.

4. The stackable serving tray as defined in claim 1 wherein said liquid container retaining portion is generally circular in outline, said food retaining portion is generally circular in outline and includes a recessed area defined by a portion of said second sidewall being concentric with and spatially related to said first sidewall, a generally horizontal bridging portion joining said concentric portions of said first and second sidewalls, and an inner edge of said slot means being a continuation of the circular outline of said food retaining portion.

* * * * *